United States Patent [19]

Stewart

[11] Patent Number: 5,002,104

[45] Date of Patent: Mar. 26, 1991

[54] CUTTERHEAD FOR AN INDUSTRIAL WOODWORKING MACHINE

[76] Inventor: John S. Stewart, 6921 Charnel La., Climax, N.C. 27233

[21] Appl. No.: 483,503

[22] Filed: Feb. 22, 1990

[51] Int. Cl.[5] ..... B27G 13/00; B27C 1/14

[52] U.S. Cl. ..... 144/230; 144/117 R; 144/221; 144/229; 144/241; 407/45; 407/51

[58] Field of Search ..... 144/221, 229, 230, 241, 144/117 R, 117 A, 117 B; 407/45, 46, 51

[56] References Cited

U.S. PATENT DOCUMENTS

| | | | |
|---|---|---|---|
| D. 239,317 | 3/1976 | Stewart . | |
| 3,785,417 | 1/1974 | Vora | 144/221 |
| 3,933,189 | 9/1974 | Boles et al. | 144/117 R |
| 4,074,737 | 2/1978 | Stewart | 144/230 |

OTHER PUBLICATIONS

Stewart, John S., "Noise Control Techniques for Double Enders", Wood & Wood Products, pp. 27–30, Sep. 1975.

Stewart, John S., "Woodworking Machinery Noise Control: A Practical Approach", Furniture Production Mag., pp. 18–23, Apr. 1977.

*Primary Examiner*—W. Donald Bray

*Attorney, Agent, or Firm*—Rhodes, Coats & Bennett

[57] ABSTRACT

A cutterhead for an industrial woodworking machine which is operable to incorporate a sufficient number of knife rows to permit a staggered tooth arrangement for noise reduction or, alternatively, to provide improved surface finish at higher feed rates without increasing cutterhead RPM. The cutterhead also provides for the generation of a variety of shapes when used with appropriately shaped individual cutting inserts. The cutterhead includes a cutterhead body having a cylindrical portion having a plurality of circumferentially spaced grooves for receiving a plurality of cutting inserts, a predetermined hole pattern in the cutterhead body for securing the cutting inserts in the grooves, and in the preferred embodiment elongated slots in the cutting inserts which permit lateral adjustment of the cutting inserts along the axis of the cutterhead. Profile shape adjustments are made through the use of a cam device. The individual cutting inserts can be replaced if broken or worn by simply exchanging the cutting inserts with properly ground cutting inserts due to the precise position repeatability afforded by the groove and slot seating design of the present invention which provides for economical, simple, and accurate replacement of the cutting inserts, thereby reducing the number of cutterheads required for a particular operation, and allowing interchangeability of cutting tool mateials by simply exchanging cutting inserts within a single head body.

40 Claims, 4 Drawing Sheets

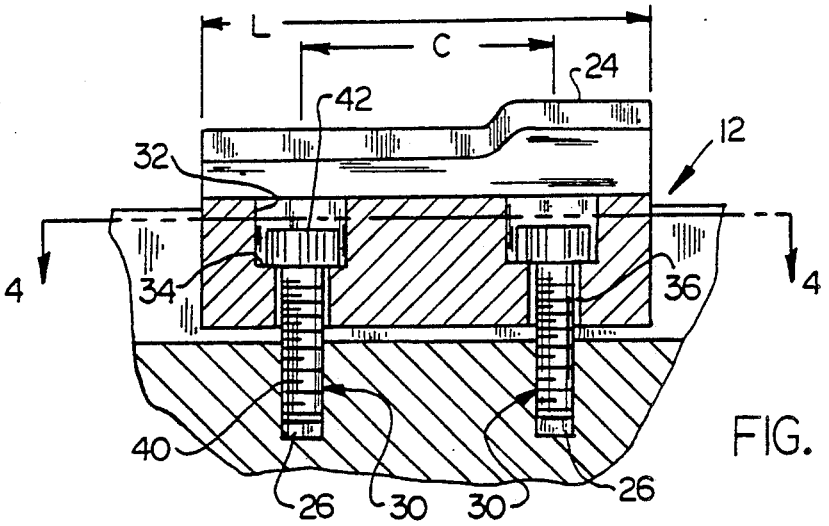
FIG. 3
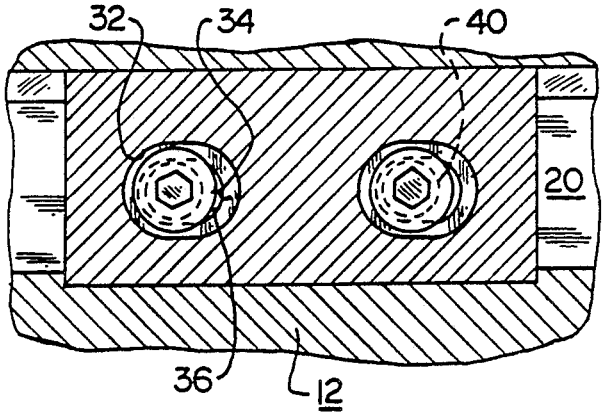
FIG. 4
FIG. 5
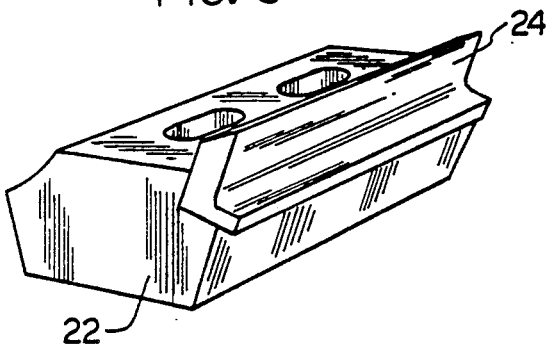
FIG. 6
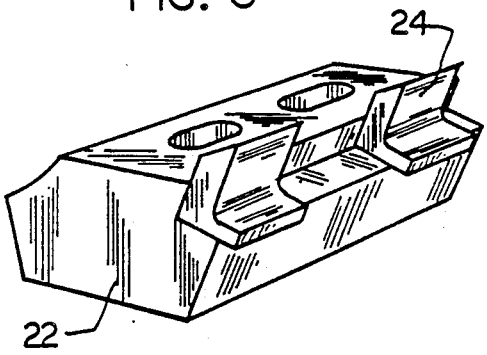

CUTTERHEAD FOR AN INDUSTRIAL WOODWORKING MACHINE

BACKGROUND OF THE INVENTION (1) Field of the Invention

The present invention relates generally to industrial wood working machines, more particularly, to large diameter cutterheads for peripheral milling machines, including high speed planers and molders.

(2) Description of the Prior Art

In wood planing applications, the need exists for cutterheads which can take advantage of the availability of new, modern day cutting materials while, at the same time, being simple and economical to maintain preferably on site with simple, inexpensive grinding equipment. In certain cases, particularly in "dimension" lumber operations, cutterheads are required to produce rounded edges on lumber of different thickness. This has typically required different cutterheads and the attendant stockpiling of a variety of cutterheads.

A wide variety of cutterhead designs exist for the wood molding industry where a multitude of different shapes are encountered. However, molding cutterheads are not used for large diameter, high speed planers used in the dimension lumber industry due to the relatively small number of knife rows possible, limitations as to cutterhead strength, and maintenance considerations Accordingly, high speed wood planers typically utilize straight knife-type tool steel or carbide tipped insert-type knives for the top and bottom heads which may be a staggered tooth or helical design. Straight knife-type tool steel heads or stacked saw-type carbide tipped profile heads are used for the side heads which often require a profile-type knife design to produce rounded edges.

Tool steel knife and continuous edge carbide knife designs have a maximum knife row capacity of about 20 for a 13 inch diameter cutterhead. Inserted tooth cutterheads and solid-type cutterheads with machined pockets for brazed on teeth are usually a staggered tooth design which requires additional knife rows since the passage of two rows is required to make a completed cut. A solid head body design with pockets for brazed on knife edges would not be limited to 20 knife rows for a 13 inch diameter cutterhead. While this design is used in some small cutterheads, it is not practical for large diameter cutterheads since it has no provision for tip replacement or profile adjustment, and has no flexibility regarding the variety of shapes produced or cutting widths obtainable or knife configuration, e.g. straight or staggered.

Switching out of entire sets of cutterhead knives when damage occurs to the cutting edges is well known for the straight knife-type tool steel top and bottom and side cutterheads. However, replacement of damaged knives is not possible for solid-type cutterheads. For high speed four sided planers, an additional and sometimes conflicting requirement includes the need to control or limit the noise level while maximizing the number of knife marks per inch. Knife marks per inch (kpi) are an indicator of surface finish quality and are given by the formula: kpi=(# of knife rows * RPM)/feed speed (ipm). For most high speed planers a 5–10 kpi surface finish is satisfactory. For example, for a feed rate of 12,000 ipm (1000 fpm) and 3600 RPM, approximately 32 rows of knives are needed to produce a 10 kpi surface finish while 16 rows of knives will produce about a 5 kpi surface finish. The goal of increasing the kpi number has generally been achieved by adding more cutterhead knives and/or increasing the speed of the cutterhead but limits to the number of knives and cutterhead RPM are being approached.

Three general types of cutterheads are in common use on high speed planers. The salient features and limitations of each design are as follows:

a. Gib-type Straight Knife Cutterhead

This cutterhead consists of a cylindrical head body with pockets which hold each gib and knife (see e.g. U.S. Pat. No. 3,933,189 issued to Boles et al). The knife itself is typically made of tool steel, however, in some cases solid carbide knives are utilized in straight knife-type cutterheads. Due to the geometry of the knife and gib system design which requires relatively large cutterhead pockets required, the use of either a staggered tooth arrangement for noise reduction or large numbers of knife rows for increased feed rates without increased RPM is limited. Furthermore, because of the clamped-in-place solid knife design, replacement of knives is tedious and is not generally attempted during production, thereby requiring that spare heads be kept on hand. Finally, the replacement of solid high speed steel or carbide knives due to breakage cause by foreign objects is quite costly.

Special shapes, i.e. profiles, can be produced by straight knife-type cutterheads by clamping appropriately shaped knives into the cutterhead. However, there is no provision for simple adjustments of position of the knives to correct for shape errors. Also, the cutting width is usually not adjustable on straight knife cutterheads due to the gib locking design. Consequently, additional heads for different cutting widths or excessively wide cutterheads must be used which results in wasted tool material. The straight knife design is also limited by the range of cutting tool materials and tool geometries available, since only materials which can be clamped, i.e. compressed, into the gib pocket can be utilized. This limitation precludes the use of many of the new cutting edge materials as well as preventing the possibility of converting from one tool material to another for different applications.

b. Stacked Saw or Solid Body Tipped Cutterheads

This type of cutterhead includes the carbide tipped design commonly found on planer side heads. It consists of either a series of carbide tipped saw blades "stacked" together to form a cutterhead or a solid body-type cutterhead with milled "seats" for brazing in carbide tips (see e.g. Stewart, John S., "Noise Control Techniques for Double Enders", Wood & Wood Products, pp. 27–30, Sept. 1975). In general, this type of cutterhead is made for a particular cutting width and has no flexibility with respect to changing cutting width or profile shape to accommodate production changes. Accordingly, additional cutterheads must be on hand.

Both cutterhead types have the disadvantage that broken tips cannot be individually replaced. Instead, the entire cutterhead must be returned to a maintenance facility. Also, after maintenance, such as grinding, these heads have no provision for the adjustment of the profile shape. Some prior art stacked saw designs attempted to use shims to adjust the profile shape of the cutterhead. However, this adjustment was difficult and required disassembly of the cutterhead.

This cutterhead design often incorporates a staggered tooth design for noise reduction. However, there is no provision for changing the cutterhead over to a non-staggered tooth arrangement to increase the effective knife marks per inch. Finally, tool materials are generally limited to those which can be brazed on in tip form, thereby precluding the use of a variety of modern tool treatments and wear resistant coatings.

c. Segmented Cutterheads

This design consists of a cutterhead body which has grooves or pockets into which individual cutter inserts are removably attached (see e.g. U.S. Pat. No. 4,074,737, issued to Stewart). A variety of mild steel bodies with carbide tips, i.e. "carbide tipped", can be bolted into the cutter body in staggered tooth, helical, or straight knife configurations. However, this cutterhead is not designed for profile cutting, has no provision for the adjustment of shape, and is not designed for varying the cutting width and will not accommodate a large number of knife rows necessary to increase feed rates while maintaining surface finish. While this type of head does offer noise reduction advantages and can be adapted to accommodate the use of a variety of cutting tool materials, there is no provision for changing over from a staggered tooth to a non-staggered tooth configuration.

It has thus become desirable to develop a cutterhead which can be configured in a conventional straight knife or staggered tooth geometry, provide for the generation of a variety of shapes and, at the same time, permit the profile shape to be adjusted. The cutterhead should provide for economical, simple maintenance and accurate replacement of cutters, thereby reducing the number of cutterheads required for a particular operation and allowing interchangeability of cutting tool materials. The cutterhead should also provide the flexibility for both noise reduction, when compared to conventional straight knife cutterheads operating at the same RPM through the use of the staggered tooth design, or, alternatively, the ability to increase the number of knife marks per inch without increasing RPM, which results in a net reduction of noise when compared to a conventional straight knife cutterhead operating at a higher RPM. Finally, the cutterhead should facilitate the use of alternative tool materials to take advantage of new technologies including facing, impregnations, etc. in addition to facilitating the use conventional tool materials including tool steel, carbides, high cobalt alloys, e.g. stellite materials.

SUMMARY OF THE INVENTION

The present invention is directed to a cutterhead which is operable to incorporate a sufficient number of knife rows to permit a staggered tooth arrangement for noise reduction or, alternatively, to provide improved surface finish at higher feed rates without increasing cutterhead RPM, and provides for the generation of a variety of shapes when used with appropriately shaped individual cutting inserts, through a cutterhead body having a cylindrical portion having a plurality of circumferentially spaced grooves for receiving a plurality of cutting inserts, a predetermined hole pattern in the cutterhead body for securing the cutting inserts in the grooves, and elongated slots in the cutting inserts which permit lateral adjustment of the cutting inserts along the axis of the cutterhead. Profile shape adjustments are made through the use of a cam device.

The individual cutting inserts can be replaced if broken or worn by simply exchanging the cutting inserts with properly ground cutting inserts due to the precise position repeatability afforded by the groove and slot seating design of the present invention which provides for economical, simple, and accurate replacement of the cutting inserts, thereby reducing the number of cutterheads required for a particular operation, and allowing interchangeability of cutting tool materials by simply exchanging cutting inserts within a single head body.

The present invention allows for either the removal and regrinding of the whole cutterhead external to the machine or the regrinding of the individual cutting inserts in an external fixture after which the cutting inserts can be precisely installed and adjusted in the cutterhead body either on or off the planer, thereby providing simple and flexible maintenance. Precision mating of the insert in the head body groove, in combination with the use of the cam device for precise lateral adjustment of the cutting inserts to match a desired cutterhead profile pattern, provides for simple buildup of the cutterhead.

The present invention provides for noise reduction by the use of a staggered tooth arrangement or the ability to increase the feed rate of the machine while maintaining the number of knife marks per inch for a given RPM, since the compact design of the present invention permits more knife rows for a straight knife cutterhead.

Finally, the present invention facilitates the use of alternative tool materials by incorporating a segmented insert which can be economically investment cast or produced in powdered metal in a variety of alloys including tool steel or stellite materials, can be tipped with a variety of materials including carbide and diamond, or can be faced, coated, or treated with a variety of modern day materials through impregnation, implantation, spray and fuse, and other emerging technologies.

Accordingly, one aspect of the present invention is to provide a cutterhead body for an industrial woodworking machine which includes a generally cylindrical portion and a plurality of circumferentially spaced grooves extending into the cutterhead body from the periphery thereof the cylindrical portion and adapted to receive a removable cutting insert. A portion of the side walls of each of the grooves are inwardly converging to substantially equally divide the forces exerted by the removable cutting insert between each of the side walls of the grooves, thereby substantially reducing the circumferential spacing required between adjacent ones of the grooves.

Another aspect of the present invention is to provide a removable cutting insert for use in a cutterhead for an industrial woodworking machine, the cutterhead having a generally cylindrical portion, a plurality of circumferentially spaced grooves extending into the cutterhead body from the periphery thereof the cylindrical portion and adapted to receive the removable cutting insert, and means for removably securing the cutting insert in the grooves. The cutting insert includes a generally parallelepiped body and at least one elongated slot in the body axially aligned with the grooves and adapted to cooperate with the means for securing the cutting inserts in the grooves, thereby permitting lateral adjustment of the position of the cutting inserts along the axis of the cutterhead.

Another aspect of the present invention is to provide a cutterhead for an industrial woodworking machine which includes a cutterhead body having a cylindrical portion, a plurality of circumferentially spaced grooves extending into the cutterhead body from the periphery thereof the cylindrical portion and adapted to receive a removable cutting insert, a plurality of cutting inserts received in each of the grooves, means for removably securing the cutting inserts in the grooves, and at least one elongated slot in each of the cutting inserts axially aligned with the grooves and adapted to cooperate with the means for securing the cutting inserts in the grooves, thereby permitting lateral adjustment of the position of the cutting inserts along the axis of the cutterhead.

Still another aspect of the present invention is to provide a removable cutting insert for use in a cutterhead for an industrial woodworking machine, the cutterhead having a generally cylindrical portion, a plurality of circumferentially spaced grooves extending into the cutterhead body from the periphery thereof the cylindrical portion and adapted to receive the removable cutting insert, and means for removably securing the cutting insert in the grooves. The cutting insert includes a generally parallelepiped body having a cutting surface aligned along one of the upper edges of the body and a gullet portion aligned along the other one of the upper edges of the body for receiving and turning the chip formed by the cutting surface, thereby substantially reducing the circumferential spacing required between adjacent of the cutting inserts in the grooves.

These and other aspects of the present invention will be more clearly understood after review of the following description of the preferred embodiment of the invention when considered with the drawings.

BRIEF DESCRIPTION OF THE DRAWINGS

FIG. 3 is a cross sectional view of the cutterhead insert shown in FIGS. 1 and 2, taken along line 3—3;

FIG. 4 is a cross sectional view of the cutterhead insert shown in FIG. 3, taken along line 4—4;

FIG. 5 is a perspective view of a cutting insert, constructed in accordance with the present invention, having a carbide tipped, continuous-type cutting edge;

FIG. 6 is a perspective view of a cutting insert, constructed in accordance with the present invention, having a carbide tipped, staggered tooth-type cutting edge;

DESCRIPTION OF THE PREFERRED EMBODIMENTS

Figure 1:
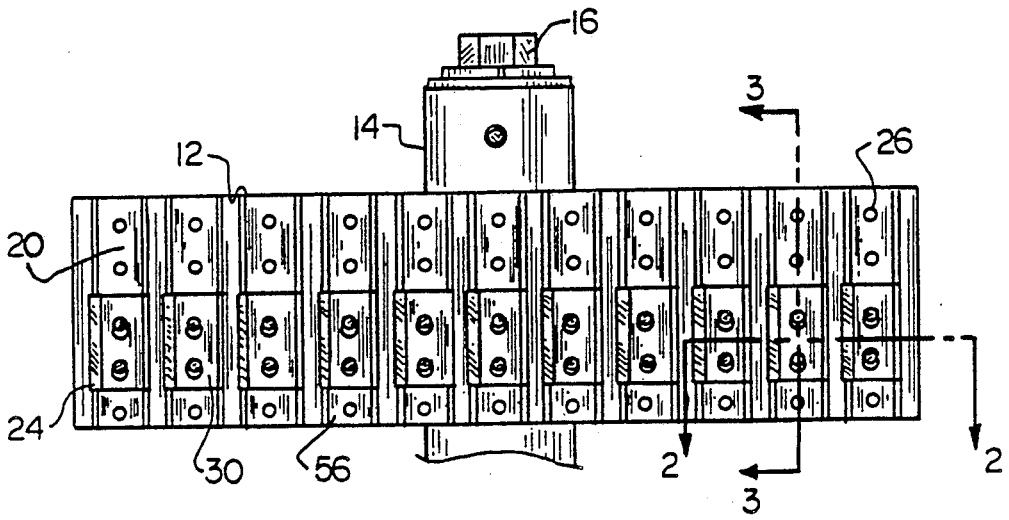
FIG. 1 is a side view of a cutterhead constructed according to the present invention.

Referring now to the drawings in general and FIG. 1 in particular, it will be understood that the illustrations are for the purpose of describing a preferred embodiment of the invention and are not intended to limit the invention thereto.

As best seen in FIG. 1, a cutterhead, generally designated 10, is shown constructed according to the present invention. The cutterhead includes a cylindrical cutterhead body 12. The overall dimensions of body 12 typically will have a diameter of between about 10 and 15 inches and a height of between about 3 and 6 inches but the actual dimensions are dependent of the requirements of the individual wood working machine. In the preferred embodiment, body 12 is formed from a cylinder of alloy steel.

Body 12 is attached to a high speed planer (not shown) by means of a rotary shaft 14. A locking means 16, such as a keyed taper shaft and locking nut assembly, secures body 12 to shaft 14. Body 12 contains a plurality of truncated "V"-shaped grooves 20 around its periphery for receiving a plurality of individual cutting inserts 22. In the preferred embodiment, cutting inserts 22 are formed from mild steel for carbide tipped inserts or from tool steel, stellite, etc.

Each of the plurality of individual cutting inserts 22 includes at least one cutting knife 24. Each of the plurality of grooves 20 includes a plurality of threaded apertures 26 generally arranged along the bottom portion of each of the grooves 20. In the preferred embodiment, the apertures 26 are spaced one inch apart from one another. Individual cutting inserts 22 are attached into grooves 20 by attachment means 30.

Figure 2:
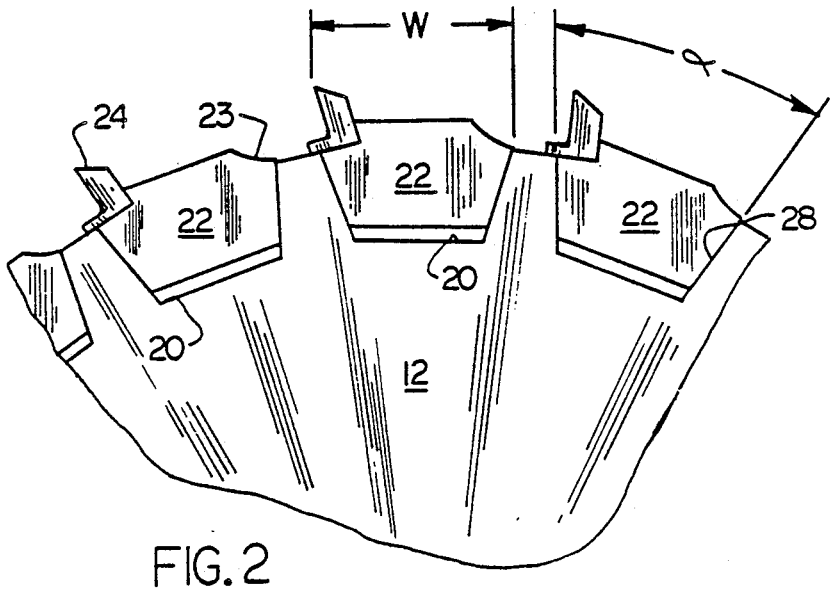
FIG. 2 is an enlarged cross sectional view of the cutterhead shown in FIG. 1, taken along line 2—2.
Figure 7:
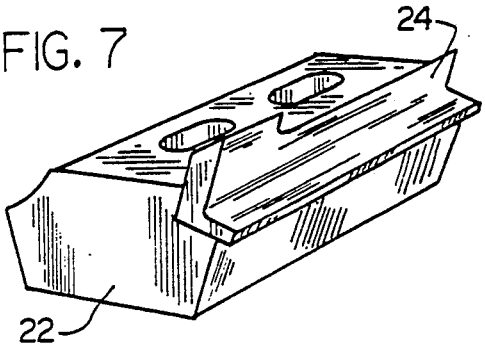
FIG. 7 is a perspective view of a cutting insert, constructed in accordance with the present invention, having a carbide tipped, continuous profile-type cutting edge.
Figure 8:
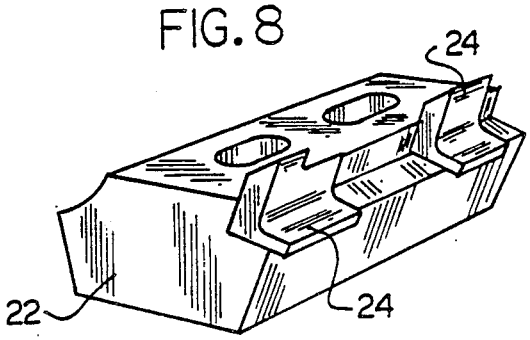
FIG. 8 is a perspective view of a cutting insert, constructed in accordance with the present invention, having a carbide tipped, staggered tooth profile-type cutting edge.
Figure 9:
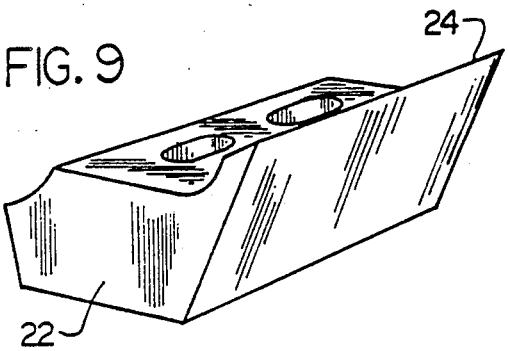
FIG. 9 is a perspective view of a cutting insert, constructed in accordance with the present invention, having a hard faced or cast cutting edge.

As best seen in FIG. 2, the angled side wall portions of cutting inserts 22 "mate" with complementary angled side wall portions of grooves 20, thereby producing a wedging action which secures the cutting inserts 22 into grooves 20. The included angle is between about 45 and 90 degrees with 60 degrees being preferred.

To improve seating, the bottom surface of each of the cutting inserts 22 may be "dimpled". When dimpled bottoms (not shown) are used, each of the cutting inserts 22 are pre-seated under sufficient pressure in a precise die having the shape of grooves 20. The dimpled bottom surface of cutting inserts 22 deforms under the high pressure, thereby providing for secure, precise, and repeatable seating of each of the cutting inserts 22 into grooves 20.

Also, in the preferred embodiment, the circumferential arc length W of each of the cutting inserts 22 is approximately one inch and the space S between adjacent cutting inserts 22 is approximately 0.20 inches for a total width, W+S, of between about 1.1 and 1.3 inches. Accordingly, a 13 inch diameter cutterhead body 12 will accommodate between about 32 and 36 knife rows of cutting inserts 22. Similarly, a 15 inch diameter cutterhead body 12 will accommodate between about 36 and 42 rows of cutting inserts 22. Thus, the ratio of the number of circumferentially spaced grooves 20 to the circumference in inches of the cutterhead body 12 is between about 0.75:1 and 0.90:1 for the present invention. To the contrary, a conventional 13 inch cutterhead body will only accommodate between about 16 and 18 rows of cutters and the ratio of the number of cutters to the circumference in inches of the cutterhead body is less than 0.5:1.

The increased number of cutting inserts 22 made possible by the present invention, when compared to conventional gib-type cutterheads, is due in part to the design of grooves 20 wherein a portion of the side walls of each of grooves 20 are inwardly converging to divide the forces exerted by the cutting insert 22. This permits the spacing S required between adjacent grooves 20 to be substantially reduced without the occurrence of warping or deforming the cutterhead body 12.

The increased number of cutting inserts 22 is also due in part to the design of the cutting insert 22 itself. In conventional cutterheads, a substantial space must be left between adjacent rows of cutters to allow for chip formation and flow. In the present invention, the edge of the cutting insert 22 opposite the cutting knife 24 includes a gullet portion 23 having approximately a ½ inch radius for receiving and turning the chip formed by the cutting knife 24, thereby reducing the space S required between adjacent cutting inserts 22. In addition, in the preferred embodiment, the lower edge of each cutting knife 24 includes a shoulder portion 25 for first receiving and turning the chip formed by the cutting knife 24 towards gullet 23. The combination of the shoulder 25 and the gullet 23 permits the spacing S required between adjacent grooves 20 to be substantially reduced, thereby allowing the number of rows of cutting inserts 22 to be increased.

Turning now to FIG. 3, there is shown a cross sectional view of the insert illustrated in FIG. 2 but along its longitudual axis. Cutting inserts 22 include a pair of counterbored apertures 32 for receiving attachment means 30. Each aperture 32 includes a shoulder portion 34 and a slot portion 36. Preferably apertures 32 are equally spaced from the longitudual ends of the cutting inserts 22 and one another, thereby distributing the load of the attachment means 30. Also, in the preferred embodiment, attachment means 30 is a threaded fastener 38 having a threaded body 40. Further, threaded fastener 38 includes an enlarged cap 42 which is adapted to contact shoulder 34.

As best seen in FIG. 4, each of the apertures 32, shoulder portion 34, and slot portion 36 are adapted to receive fasteners 38 while, at the same time, permit each of the fasteners 38 to move laterally along the horizontal axis of the cutting inserts 22 within each of the apertures 32. This construction permits lateral movement of the cutting inserts 22, thereby facilitating the adjustment of profile shapes required at initial setup or after reworking, regrinding, etc.

Cutting inserts 22 preferably are two inches in overall length so that material surfaces up to two inches in width can be surfaced with only one insert per row. Cutting inserts 22 may be abutted together to produce increases in cutting widths in two inch increments, thereby reducing the number of cutterheads 12 required for high speed planers producing more than one product.

The two inch long insert design is also important from an economy standpoint, since the cost of replacement or repair of a single damaged insert may be substantially less that replacement of an entire cutterhead knife, depending on cutterhead width. The two inch insert facilitates the use of investment cast or powder metal cutting inserts which can be produced economically and in a variety of materials, including tool steel and stellites. Casting of the insert facilitates the manufacture of tipped cutting inserts as well as cutting inserts suitable for surface treatments.

As best seen in FIGS. 5 through 9, cutting inserts 22 incorporate one or more cutting edges which may be brazed on, mechanically fastened, or welded on deposits which are ground to form proper cutting angles. In addition, the cutting inserts 22 may be made from tool steel, mild steel, stellite, etc. which can be hardened or treated, or made from a suitable base material which can be surface treated near the cutting tip by induction hardening, case hardening, ion implantation, spray and fuse impregnation techniques, cryogenic treatments, etc. Since cutting inserts 22 are inter-changeable, cutting edge materials can be chosen for specific operational requirements by simply replacing cutting inserts in cutterhead body 12, thereby eliminating the need to have additional heads available. Profile patterns, such as rounded edges on 2"×4"s, are facilitated through the use of special cutting inserts with the profile ground into the cutting edge.

Figure 10:
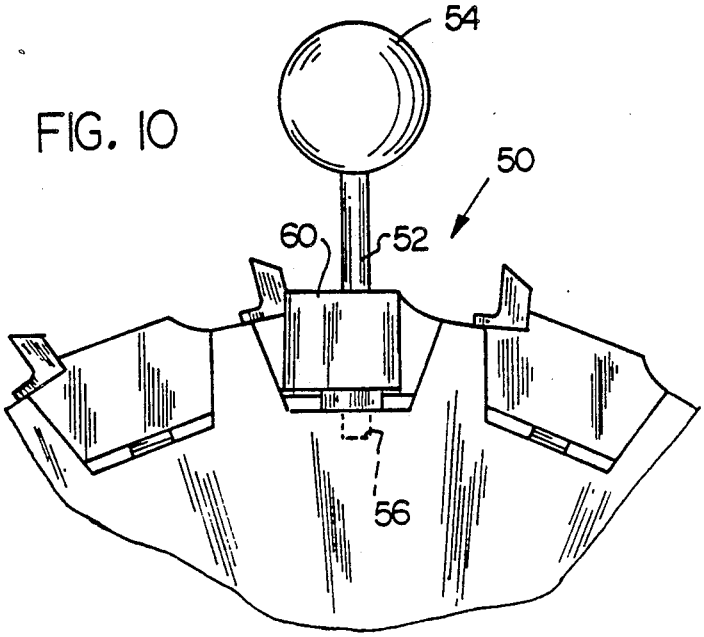
FIG. 10 is an enlarged side view of the cutterhead shown in FIG. 1 illustrating the cam device.

Turning now to FIG. 10, when such patterns are utilized, it is essential that the pattern width be adjustable to accommodate initial setup as well as provide a means of correcting the profile dimensions after regrinding, etc. Accordingly, the present invention includes a removable cam device, generally designated 50, for precisely setting the lateral adjustment permitted by the slots 36 in the cutting inserts 22 which, when used either alone or in conjunction with a conventional profile setting gage (not shown), permits accurate lateral adjustment of cutting inserts 22. Cam device 50 includes a generally cylindrical elongated shaft 52 having a ball handle 54 attached to one end. The other end of shaft 54 is adapted to be received by each of a plurality of precisely reamed holes 56 in each of grooves 20 of cutterhead body 12 adjacent to threaded holes 26. An eccentric cam 60 is securely mounted to shaft 52 and is adapted to contact the adjacent end of cutting insert 22 and function as a stop. The upper surface of cam 60 includes means for indicating the radial position of cam 60, such as degree markings, thereby allowing the positioning of cam device 50 to be accurately repeated for each of cutting inserts 22.

Figure 11:
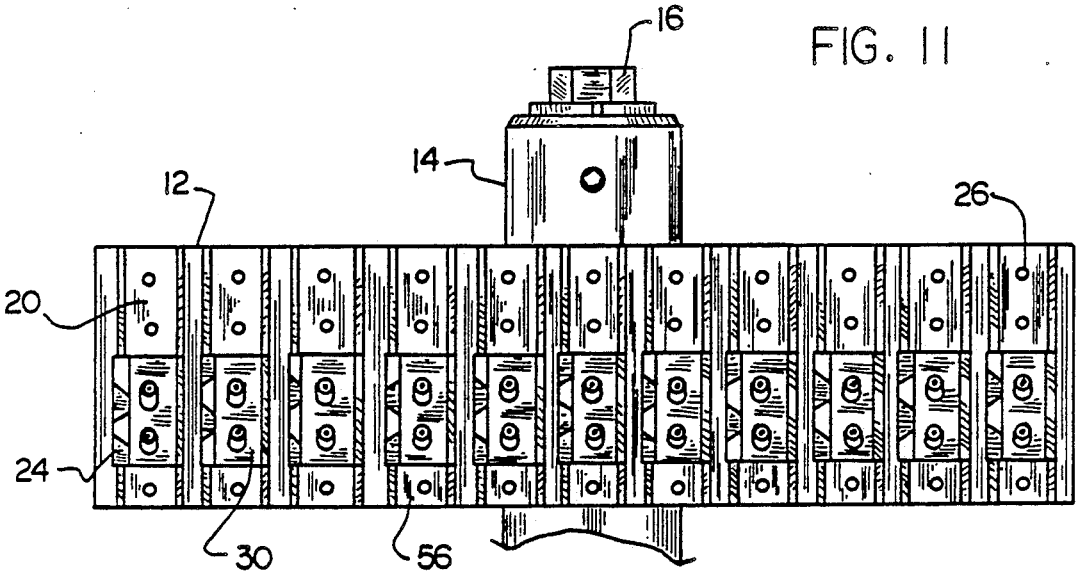
FIG. 11 is a side view of a cutterhead, constructed according to the present invention, having a staggered tooth arrangement.

Turning now to FIG. 11, cutterhead 10 is shown having the cutting inserts 22 in a staggered tooth arrangement. The staggered tooth arrangement reduces noise levels during idling by providing an escape route for the entrained air as opposed to being compressed by interaction with a nearby stationary surface such as on most wood planers. During cutting, noise is reduced by the reduced width of impact at any given instant as well as a more continuous engagement of the cutting knives, thereby smoothing out the fluctuating component of cutting force. The cutting knives 24 are staggered in such a manner as to overlap so that the passage of two rows produces a full cut. In the present invention, up to 36 rows of cutting inserts 22 can be accommodated on a 13" diameter cutterhead. Thus, a surface finish equivalent to a conventional 18 knife cutterhead can be achieved while, at the same time, obtaining the noise control benefits of the staggered tooth arrangement.

On the other hand, in the straight knife configuration a cutterhead constructed according to the present invention will produce a surface finish equivalent to a cutterhead having 36 knives which is nearly twice the maximum number of knives previously possible with conventional high speed planer heads. In order to obtain an equivalent surface finish, a conventional straight knife cutterhead would have to be rotated at nearly double its normal operating speed in order to produce a 36 knife finish. Thus the present invention provides a 2:1 advantage in cutterhead RPM for comparable knife work when compared with conventional cutterheads. Furthermore, tests of conventional cutterheads have shown air flow noise increases at an astounding 12 dB for a doubling of tip speed at idle. This advantage represents a substantial increase in surface finish without an increase in noise level due to no increase in tip speed.

In operation, the cam device 50 first is inserted into aperture 56 in the cutterhead body 12 and then is rotated to function as a precision adjustable stop against which the cutting inserts 22 are held and then locked in place by fasteners 38. This system is a significant improvement over prior art systems which had no means for permitting accurate and repeatable lateral positioning of each of the cutting inserts 22.

Routine maintenance of the cutterhead can be accomplished through regrinding the cutterhead as a unit or grinding the individual cutting inserts in a fixture. Thus, the present invention provides the user flexibility in choosing a method of maintenance to suit particular needs.

Certain modifications and improvements will occur to those skilled in the art upon reading of the foregoing description. By way of example, the dimensions of the cutting inserts and the spacing between adjacent grooves can be varied depending on the particular application of the cutterhead. Also, the geometries of either or both of the gullet and shoulder portions of the cutting insert could be further refined without undue experimentation. It should be understood that all such modifications and improvements have been deleted herein for the sake of conciseness and readability but are properly within the scope of the following claims.

I claim:

1. A removable cutting insert for use in a cutterhead for an industrial woodworking machine, said cutterhead including a generally cylindrical portion, a plurality of circumferentially spaced grooves extending into said cutterhead body from the periphery thereof said cylindrical portion and adapted to receive said removable cutting insert, and means for removably securing said cutting insert in said grooves, said cutting insert comprising:

(a) a generally parallelepiped body; and (b) at least one elongated slot in said body axially aligned with said grooves and adapted to cooperate with said means for securing said cutting inserts in said grooves, thereby permitting lateral adjustment of the position of said cutting inserts along the axis of the cutterhead.

2. The cutting insert according to claim 1, further including a cutting surface aligned along one of the upper edges of said body.

3. The cutting insert according to claim 2, wherein said cutting surface is carbide tipped.

4. The cutting insert according to claim 2, wherein said cutting surface forms a continuous-type edge.

5. The cutting insert according to claim 2, wherein said cutting surface forms a staggered tooth-type cutting edge.

6. The cutting insert according to claim 2, wherein said cutting surface forms a continuous profile-type cutting edge.

7. The cutting insert according to claim 2, wherein said cutting surface forms a staggered tooth profile-type cutting edge.

8. The cutting insert according to claim 2, wherein said cutting surface includes a hard faced or cast cutting edge.

9. The cutting insert according to claim 1, wherein a portion of the side walls of said generally parallelepiped body are inwardly converging to substantially equally divide the forces exerted by said removable cutting insert between each of the side walls of said grooves, thereby substantially reducing the circumferential spacing required between adjacent ones of said grooves.

10. A cutterhead for an industrial woodworking machine, said cutterhead comprising:

(a) a cutterhead body having a cylindrical portion;

(b) a plurality of circumferentially spaced grooves extending into said cutterhead body from the periphery thereof said cylindrical portion and adapted to receive a removable cutting insert;

(c) a plurality of cutting inserts received in each of said grooves;

(d) means for removably securing said cutting inserts in said grooves; and (e) at least one elongated slot in each of said cutting inserts axially aligned with said grooves and adapted to cooperate with said means for securing said cutting inserts in said grooves, thereby permitting lateral adjustment of the position of said cutting inserts along the axis of the cutterhead.

11. The cutterhead body according to claim 10, wherein a portion of the side walls of each of said grooves are inwardly converging to substantially equally divide the forces exerted by said removable cutting insert between each of the side walls of said grooves, thereby substantially reducing the circumferential spacing required between adjacent ones of said grooves.

12. The cutterhead body according to claim 11, wherein the ratio of the number of said circumferentially spaced grooves to the circumference in inches of said generally cylindrical portion is greater than 0.5:1.

13. The cutterhead body according to claim 11, wherein the ratio of the number of said circumferentially spaced grooves to the circumference in inches of said generally cylindrical portion is between about 0.75:1 and 0.90:1.

14. The cutterhead body according to claim 11, wherein the included angle between said converging side walls is between about 45 and 90 degrees.

15. The cutterhead body according to claim 14, wherein the included angle between said converging side walls is about 60 degrees.

16. The cutterhead according to claim 10, wherein said grooves extend continuously from adjacent one axial end of said cutterhead body to adjacent the other axial end of said cutterhead body.

17. The cutterhead according to claim 10, wherein the axial dimension of said cylindrical portion of said cutterhead body is substantially less than the diameter of said body.

18. The cutterhead according to claim 17, wherein the base portion of said grooves is less than the corresponding dimension of said removable cutting insert.

19. The cutterhead according to claim 10, wherein said grooves include a predetermined hole pattern along the base portion of said grooves adapted to receive a threaded fastener for removably securing said cutting inserts.

20. The cutterhead according to claim 10, wherein said cutting insert includes a generally parallelepiped body.

21. The cutterhead according to claim 10, wherein said cutting inserts further include a cutting surface aligned along one of the upper edges of said cutting inserts.

22. The cutterhead according to claim 21, wherein said cutting surface is carbide tipped.

23. The cutterhead according to claim 21, wherein said cutting surface forms a continuous-type edge.

24. The cutterhead according to claim 21, wherein said cutting surface forms a staggered tooth-type cutting edge.

25. The cutterhead according to claim 21, wherein said cutting surface forms a continuous profile-type cutting edge.

26. The cutterhead according to claim 21, wherein said cutting surface forms a staggered tooth profile-type cutting edge.

27. The cutterhead according to claim 21, wherein said cutting surface includes a hard faced or cast cutting edge.

28. The cutterhead according to claim 10, wherein a portion of the side walls of said cutting inserts are inwardly converging to substantially equally divide the forces exerted by said removable cutting inserts between each of the side walls of said grooves, thereby substantially reducing the circumferential spacing required between adjacent ones of said grooves.

29. The cutterhead according to claim 10, wherein said cutting inserts are in circumferentially adjacent grooves.

30. The cutterhead according to claim 29, wherein said cutting inserts are in axially spaced relation to one another.

31. The cutterhead according to claim 29, wherein said cutting inserts are axially staggered with respect to the cutting inserts in adjacent grooves.

32. The cutterhead according to claim 10, further including a means for adjusting the lateral position of said cutting inserts, said means including a generally cylindrical elongated shaft, a plurality of precisely reamed openings in each of said grooves of said cutterhead body adjacent to said cutting inserts, and an eccentric cam mounted to said shaft and adapted to contact the adjacent end of each of said cutting inserts and function as a stop, thereby allowing the positioning to be accurately repeated for each of said cutting inserts.

33. The cutterhead according to claim 32, wherein the upper surface of said cam includes means for setting a predetermined radial position of said cam.

34. A removable cutting insert for use in a cutterhead for an industrial woodworking machine, said cutterhead including a generally cylindrical portion, a plurality of circumferentially spaced grooves extending into said cutterhead body from the periphery thereof said cylindrical portion and adapted to receive said removable cutting insert, and means for removably securing said cutting insert in said grooves, said cutting insert comprising:

(a) a generally parallelepiped body having a cutting surface aligned along one of the upper edges of said body;

(b) a gullet portion aligned along the other one of the upper edges of said body for receiving and turning the chip formed by said cutting surface, thereby substantially reducing the circumferential spacing required between adjacent of said cutting inserts in said grooves; and (c) a shoulder portion aligned along the lower edge of said cutting surface for receiving the chip formed by said cutting surface and adapted to cooperate with said gullet portion.

35. The cutting insert according to claim 34, wherein said cutting surface is carbide tipped.

36. The cutting insert according to claim 34, wherein said cutting surface forms a continuous-type edge.

37. The cutting insert according to claim 34, wherein said cutting surface forms a staggered tooth-type cutting edge.

38. The cutting insert according to claim 34, wherein said cutting surface forms a continuous profile-type cutting edge.

39. The cutting insert according to claim 34, wherein said cutting surface forms a staggered tooth profile-type cutting edge.

40. The cutting insert according to claim 34, wherein said cutting surface includes a hard faced or cast cutting edge.

* * * * *